US011646149B2

(12) United States Patent
Lin et al.

(10) Patent No.: US 11,646,149 B2
(45) Date of Patent: May 9, 2023

(54) STRUCTURE OF MAGNETIC INDUCTIVE COIL MODULE

(71) Applicants: Chih-Hung Lin, New Taipei (TW); Kun-Chuan Chang, New Taipei (TW)

(72) Inventors: Chih-Hung Lin, New Taipei (TW); Kun-Chuan Chang, New Taipei (TW)

(73) Assignee: PIN SHINE INDUSTRIAL CO., LTD., New Taipei (TW)

( * ) Notice: Subject to any disclaimer, the term of this patent is extended or adjusted under 35 U.S.C. 154(b) by 521 days.

(21) Appl. No.: 16/792,273

(22) Filed: Feb. 16, 2020

(65) Prior Publication Data

US 2021/0225579 A1 Jul. 22, 2021

(51) Int. Cl.

| | |
|---|---|
| ***H01F 27/28*** | (2006.01) |
| ***H01F 27/06*** | (2006.01) |
| ***H01F 27/24*** | (2006.01) |

(52) U.S. Cl.

CPC ..... *H01F 27/2823* (2013.01); *H01F 27/06* (2013.01); *H01F 27/24* (2013.01)

(58) Field of Classification Search

CPC ..... H01F 27/2823; H01F 27/06; H01F 27/24; H01F 27/2866; H01F 27/306; H01F 27/325; H01F 2017/002; H01F 2017/067; H01F 17/0013; H01F 5/06; H01F 27/323; H01F 27/324; H01F 41/122; H01F 41/125; H01F 27/28; H01F 27/2804; H01F 2027/2809; H01F 19/00; H01F 2027/2819; H01F 2027/2814

See application file for complete search history.

(56) References Cited

U.S. PATENT DOCUMENTS

| | | | | |
|---|---|---|---|---|
| 2008/0211613 | A1* | 9/2008 | Lin | H01F 27/2866 336/83 |
| 2012/0154095 | A1* | 6/2012 | Li | H01F 27/325 336/199 |
| 2013/0188329 | A1* | 7/2013 | Chang | H01F 27/2866 361/836 |
| 2015/0364245 | A1* | 12/2015 | Jang | H01F 27/2804 336/208 |

* cited by examiner

*Primary Examiner* — Lincoln D Donovan
*Assistant Examiner* — Alex W Lam

(57) ABSTRACT

A coil module includes a first coil set; a second coil set, including a first coil body, a second coil body and an insulative separator disposed between the first coil body and the second coil body, the separator having an adopting hole, the first coil body having an open winding surrounding the adapting hole and fixed on a side of the separator, the second coil body having an open winding surrounding the adapting hole and fixed on another side of the separator; and a coil base sheathing the second coil set with exposing the adopting hole. The first coil set surrounds the adopting hole and is fixed on the coil base to form a coil module.

6 Claims, 7 Drawing Sheets

STRUCTURE OF MAGNETIC INDUCTIVE COIL MODULE

TECHNICAL FIELD

The invention relates to coil modules used for inductors or transformers.

RELATED ART

A magnetic inductive element such as a transformer usually includes two independent coil sets, namely, a primary coil and a secondary coil. The transformer winding voltage ratio is directly proportional to the winding turns ratio.

In actual applications, the transformer is mounted on an independent insulative base. The insulative base is disposed with pins or contacts in advance for connecting with the coils to form a transformer assembly. The transformer assembly can be connected with an external circuit through the pins or contacts. Also, the base serves as isolator to prevent interference.

US patent publication No. 2013/0278371 teaches a planar transformer, which puts pre-made planar coils (including a primary winding and a secondary winding) around the core in order. A base with pins is connected with the coils and an external circuit by soldering. The base serves as an isolator and a protector of the core and the external circuit. However, such as transformer has following drawbacks in the manufacturing and assembling process:

1. Isolation with safety distance is lacked between coils. Even if the coils are coated with insulative paint to function as isolation, it is hard to meet the requirements of safety specification of transformer, especially for a coil with high turns. For example, an AC-DC transformer connected to wall power is easy to be damaged in operation if insulative isolation between the primary winding and the secondary winding is not good enough because of high voltage of the power side.

2. Each of the winding is an independent unit. When the windings is assembled with a core, a central magnetic column of the core must pass through assembling holes of the windings, so alignment of the assembling holes must be so accurate. As a result, the assembling difficulty increases, the yield rate decreases and the working hour is long. Also, the automatic process is hard to be applied, so it is disadvantageous to mass-production.

3. Those pins are fixed to an independent base in advance. Terminals of all windings must be connected to the pins one-to-one. When the number of windings is high, it must affect the manufacturing efficiency. The more the times of connection is, the easier the mistake occurs, such as blind joint or misconnection. This will decrease the yield rate.

SUMMARY OF THE INVENTION

An object of the invention is to provide an improved structure of magnetic inductive coil module, which is advantageous to automatic mass-production. The coil module is easy to serve as an inductor or a transformer. Also, the yield rate and reliability of the final product can be increased.

To accomplish the above object, the magnetic inductive coil module of the invention includes: a first coil set; a second coil set, comprising an independent first coil body, an independent second coil body and an insulative separator disposed between the first coil body and the second coil body, the separator having an adopting hole, the first coil body having an open winding surrounding the adapting hole and fixed on a side of the separator, the winding having two ends which separately serve as a first contact end for connecting with an external circuit and a first connecting end connected with the second coil body, the second coil body having an open winding surrounding the adapting hole and fixed on another side of the separator, and the winding having two ends which separately serve as a second contact end for connecting with the external circuit and a second connecting end connected with the first coil body; and a coil base, sheathing the second coil set with exposing the adopting hole, the first contact end of the first coil body and the second contact end of the second coil body; wherein the first coil set surrounds the adopting hole and is fixed on the coil base to form a coil module.

The first coil set is a conductive wire. Conductive pins are disposed at an end of the coil base, which is located away from the first contact end and the second contact end. A necked bar is formed around the adapting hole. The first coil set is fixed on the necked bar. Thus, the turns of the first coil set can be adjusted.

A positioning trough separately corresponding to either of the first coil body and the second coil body is formed on one of two opposite sides of the separator for separately positioning the first coil body and the second coil body. This is advantageous to the subsequent process.

The separator is further formed with a positioning hole for being passed by the second contact end to enhance the connection between the first and second coil bodies and the separator.

DETAILED DESCRIPTION OF THE INVENTION

Figure 1:
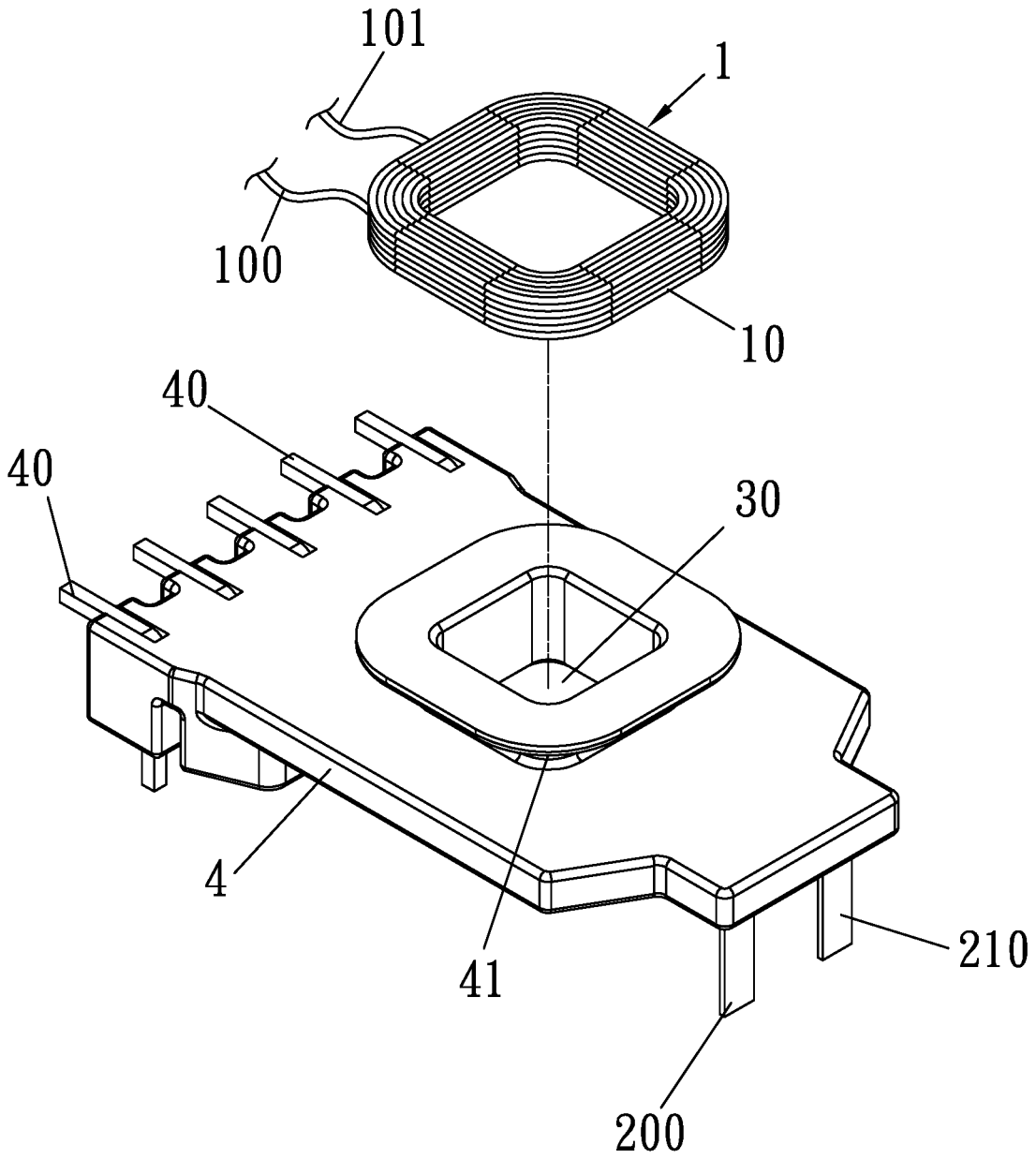
FIG. 1 is a perspective view of the coil module of the invention.
Figure 2:
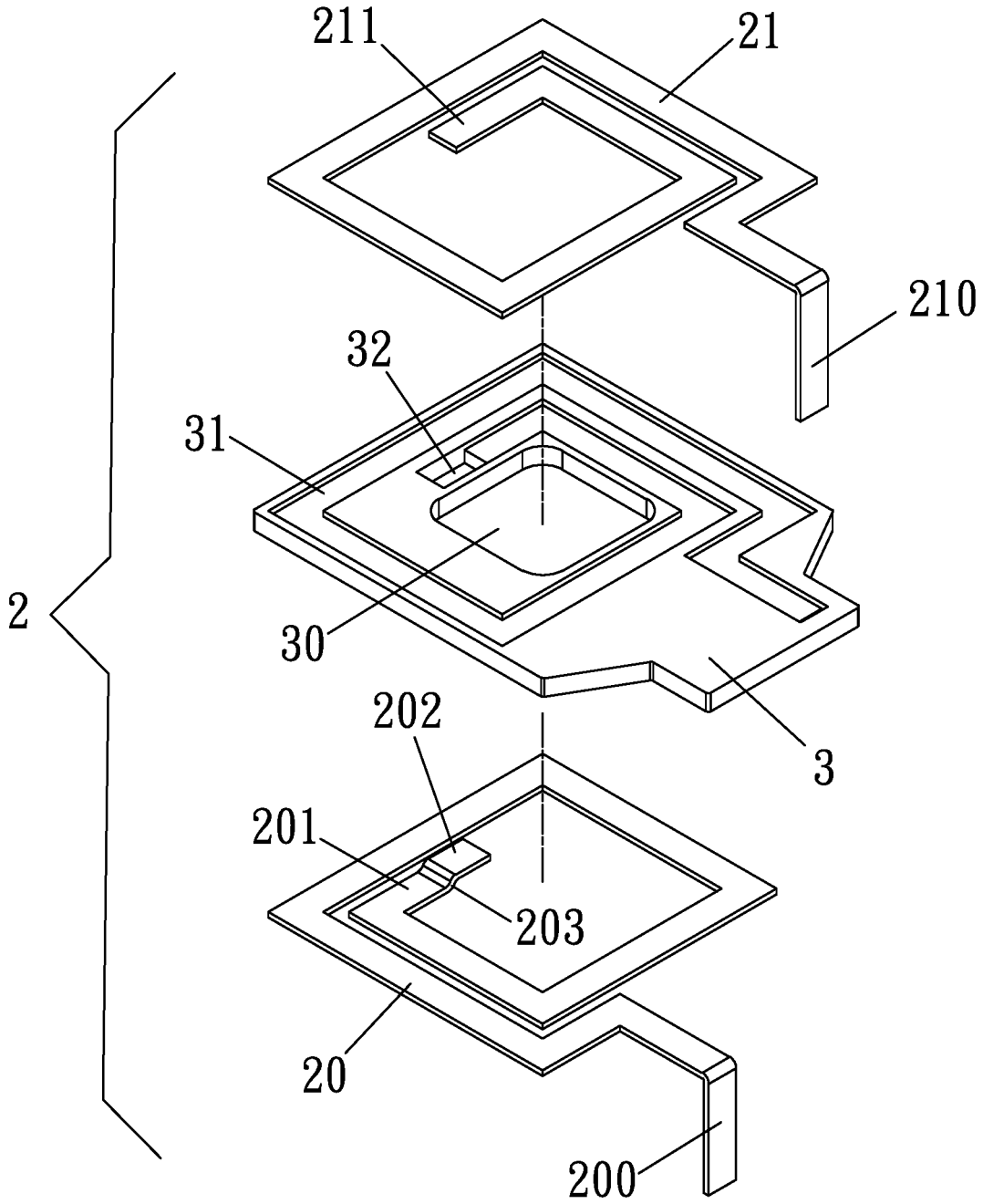
FIG. 2 is an exploded view of the second coil set of the invention.
Figure 3:
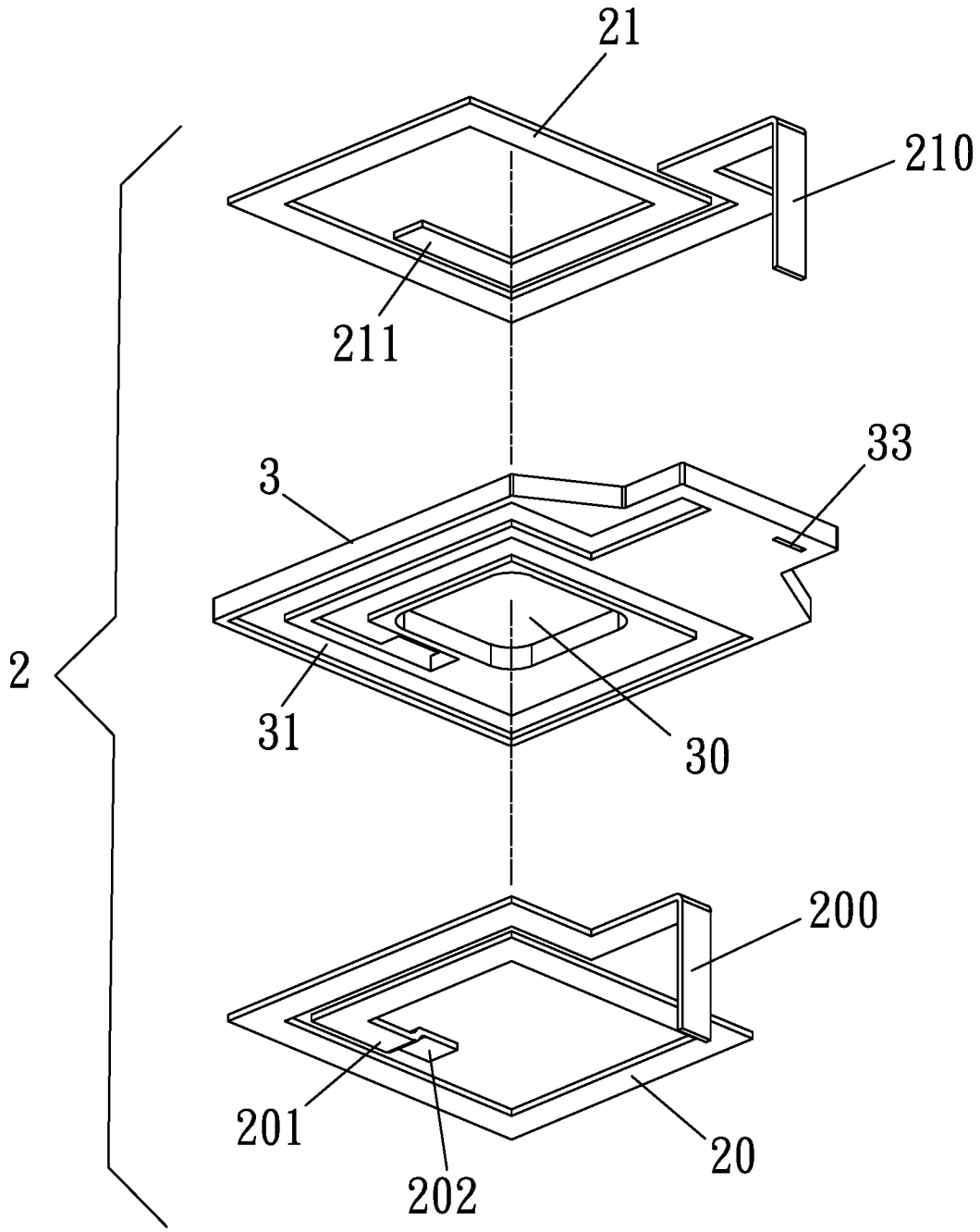
FIG. 3 is another exploded view of the second coil set of the invention.
Figure 4:
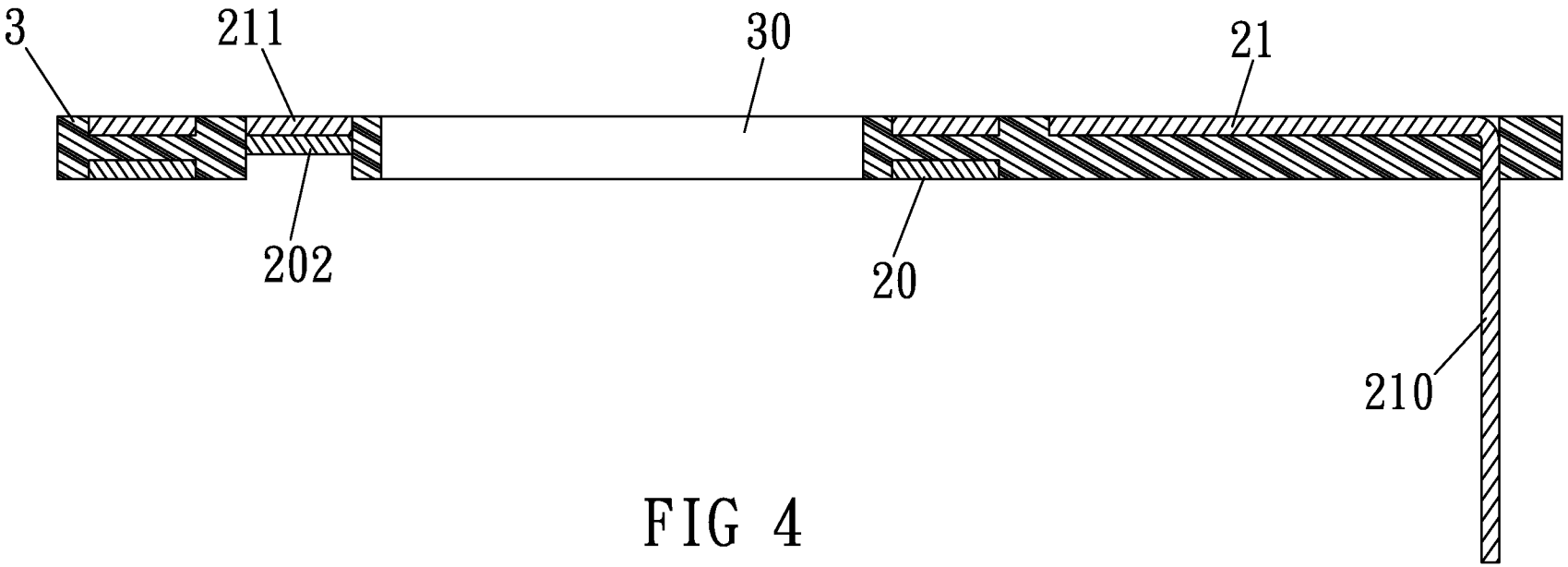
FIG. 4 is a cross-section view of the second coil set of the invention.
Figure 5:
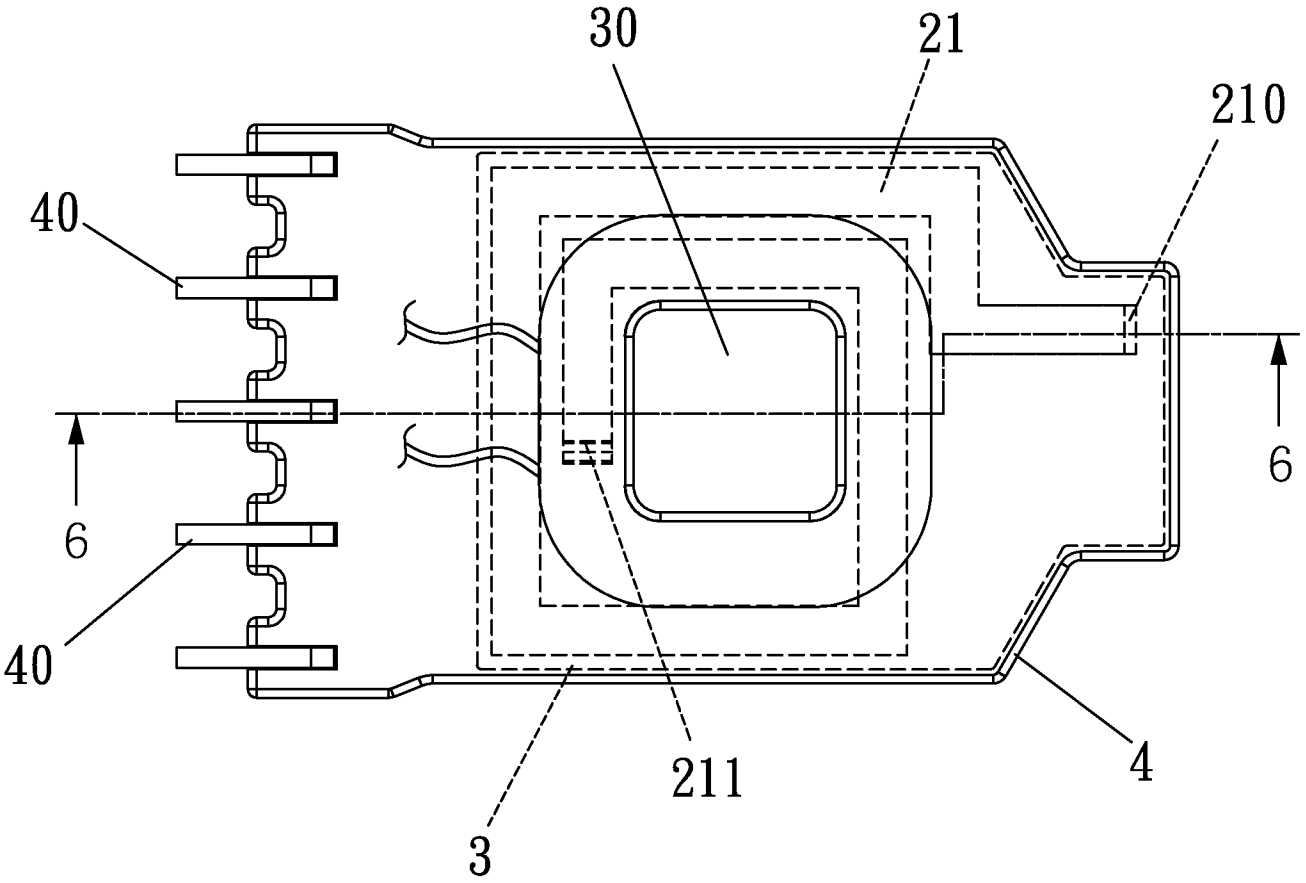
FIG. 5 is a top view of the coil module of the invention.
Figure 6:
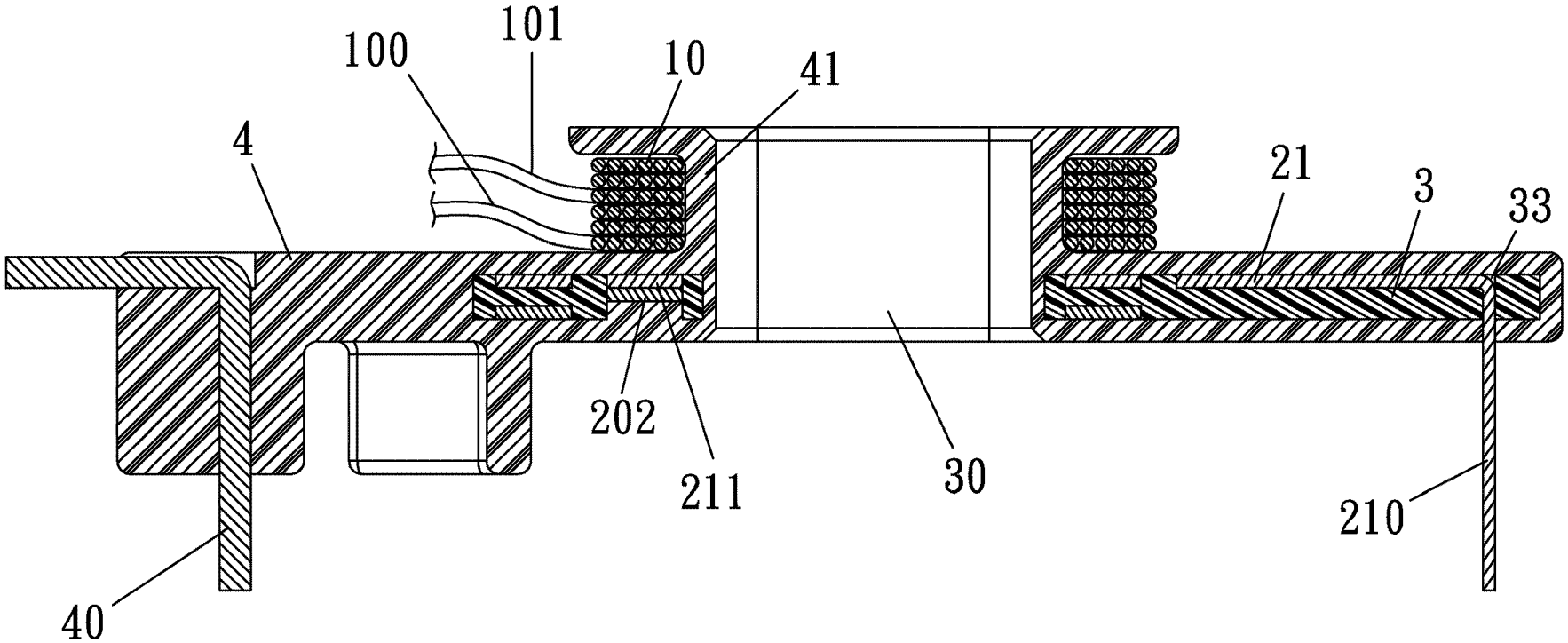
FIG. 6 is a cross-section view of FIG. 5 along line 6-6.
Figure 7:
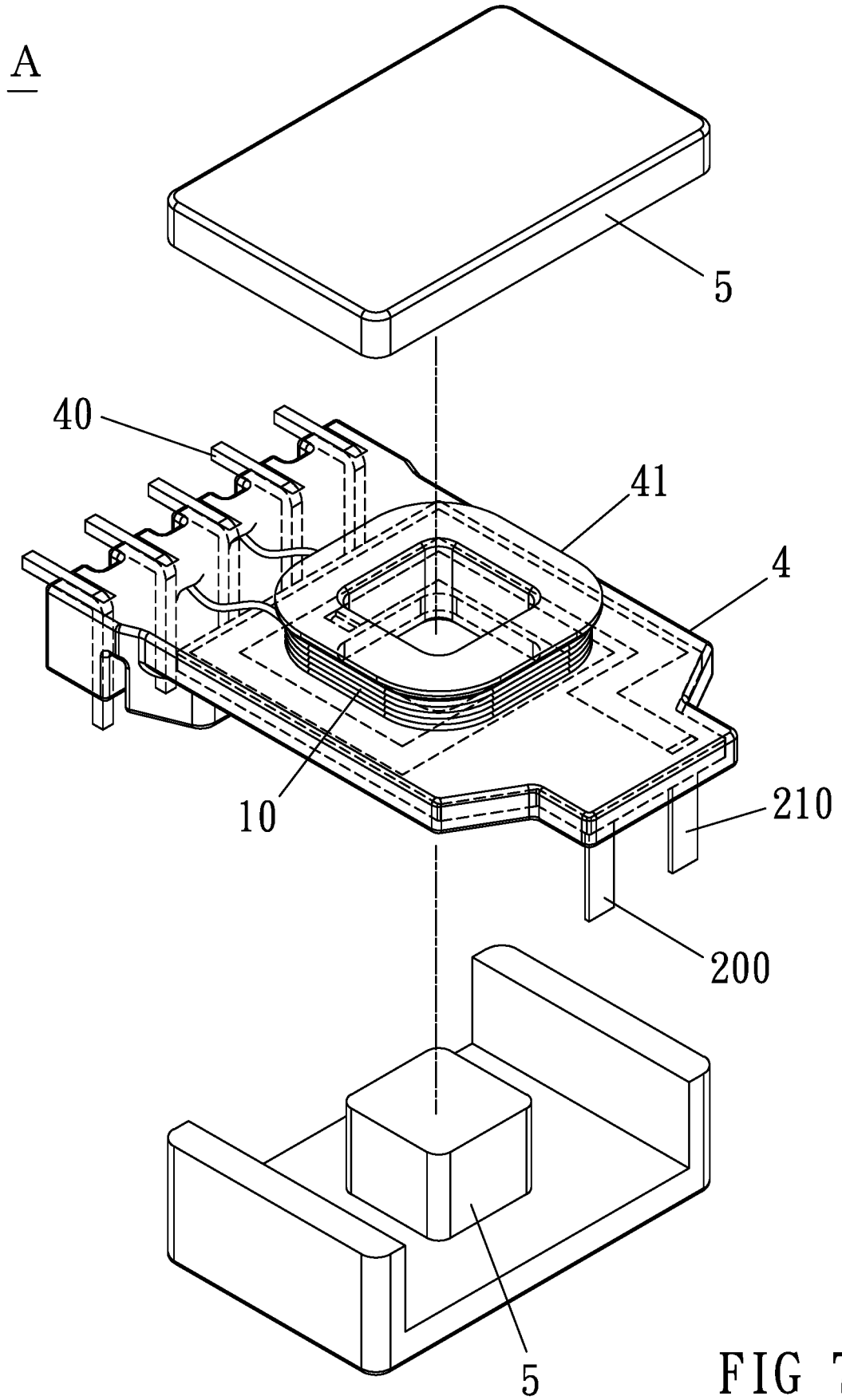
FIG. 7 is a schematic view of the coil module of the invention as a transformer.

The invention is a coil module, which can be used to serve as a magnetic inductive element such as a transformer (A) shown in FIG. 7.

Please refer to FIGS. 1-6. The coil module of the invention includes a first coil set 1 and a second coil set 2. Take a transformer as an example, the first coil set 1 and the second coil set 2 can be deemed as a primary coil and a secondary coil of the transformer, respectively. The second coil set 2 includes an independent first coil body 20, an independent second coil body 21 and an insulative separator 3 disposed between the first coil body 20 and the second coil body 21.

Each of the first coil body 20 and the second coil body 21 is made of conductive material and is a planar coil made by molding, pressing or other processes. The first coil body 20 has an open winding with two ends. One of the two ends is a first contact end 200 for connecting with an external circuit and the other end is a first connecting end 201 connected with the second coil body 21. The second coil body 21 has an open winding with two ends. One of the two ends is a second contact end 210 for connecting with the external circuit and the other end is a second connecting end 211 connected with the first coil body 20. Preferably, the first connecting end 201 is extended with a first joint portion 202 toward the second connecting end 211. A bending portion 203 is disposed between the first joint portion 202 and the first connecting end 201 to make the first joint portion 202 flexible.

The separator 3 is made of insulative material and disposed between the first coil body 20 and the second coil body 21 for isolation. The separator 3 has an adopting hole 30 through which a core 5 of the transformer A passes (see FIG. 7). Preferably, a positioning trough 31 separately corresponding to either of the first coil body 20 and the second coil body 21 is formed on one of two opposite sides of the separator 3 for separately positioning the first coil body 20 and the second coil body 21. The separator 3 is formed with a through hole 32 corresponding to the first joint portion 202 for being inserted by the first joint portion 202 to be in contact with the second connecting end 211 and to be soldered. As a result, the first coil body 20 and the second coil body 21 can be fixed on the separator 3 in advance and connected with each other to form the second coil set 2. Preferably, the separator 3 is further formed with a positioning hole 33 for being passed by the second contact end 210 to enhance the connection between the first and second coil bodies 20, 21 and the separator 3.

A coil base 4 is formed by insulative material sheathing the second coil set 2 with exposing the adopting hole 30, and the first contact end 200 of the first coil body 20 and the second contact end 210 of the second coil body 21 for connecting with an external circuit. At an end of the coil base 4, which is away from the first contact end 200 of the first coil body 20 and the second contact end 210 of the second coil body 21, conductive pins 40 are disposed in advance. A necked bar 41 is formed around the adapting hole 30. The first coil set 1 is fixed on the necked bar 41. In the shown embodiment, the first coil set 1 is wound by a conductive wire 10 which can be an enameled wire. The conductive wire 10 is wound on the necked bar 41. Two ends of the conductive wire 10 are separately connected to the conductive pins 40 for connecting with an external circuit.

As shown in FIG. 7, the adopting hole 30 is inserted by the core 5 to form a transformer A.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A magnetic inductive coil module comprising:

a first coil set;

a second coil set, comprising an independent first coil body, an independent second coil body and an insulative separator disposed between the first coil body and the second coil body, the separator having an adopting hole, the first coil body having an open winding surrounding the adapting hole and fixed on a side of the separator, the winding having two ends which separately serve as a first contact end for connecting with an external circuit and a first connecting end connected with the second coil body, the second coil body having an open winding surrounding the adapting hole and fixed on another side of the separator, and the winding having two ends which separately serve as a second contact end for connecting with the external circuit and a second connecting end connected with the first coil body; and a coil base, sheathing the second coil set with exposing the adopting hole, the first contact end of the first coil body and the second contact end of the second coil body;

wherein the first coil set surrounds the adopting hole and is fixed on the coil base to form a coil module, the first connecting end is extended with a first joint portion toward the second connecting end, and the separator is formed with a through hole corresponding to the first joint portion for being inserted by the first joint portion to be in contact with the second connecting end.

2. The magnetic inductive coil module of claim 1, wherein the first coil set is a conductive wire wound on the coil base.

3. The magnetic inductive coil module of claim 2, further comprising conductive pins disposed at an end of the coil base, which is located away from the first contact end and the second contact end.

4. A magnetic inductive coil module comprising:

a first coil set;

a second coil, set, comprising an independent first coil body, an independent second coil body and an insulative separator disposed between the first coil body and the second coil body, the separator having an adopting hole, the first coil body having an open winding surrounding the adapting hole and fixed on a side of the separator, the winding having two ends which separately serve as a first contact end for connecting with an external circuit and a first connecting end connected with the second coil body, the second coil body having an open winding surrounding the adapting hole and fixed on another side of the separator, and the winding having two ends which separately serve as a second contact end for connecting with the external circuit and a second connecting end connected with the first coil body; and a coil base, sheathing the second coil set with exposing the adopting hole, the first contact end of the first coil body and the second contact end of the second coil body;

wherein the first coil set surrounds the adopting hole and is fixed on the coil base to form a coil module, a positioning trough separately corresponding to either of the first coil body and the second coil body is formed on one of two opposite sides of the separator for separately positioning the first coil body and the second coil body.

5. The magnetic inductive coil module of claim 1, wherein a bending portion is disposed between the first joint portion and the first connecting end to make the first joint portion flexible.

6. A magnetic inductive coil module comprising:

a first coil set;

a second coil set, comprising an independent first coil body, an independent second coil body and an insulative separator disposed between the first coil body and the second coil body, the separator having an adopting hole, the first coil body having an open winding surrounding the adapting hole and fixed on a side of the separator, the winding having two ends which separately serve as a first contact end for connecting with an external circuit and a first connecting end connected with the second coil body, the second coil body having an open winding surrounding the adapting hole and fixed on another side of the separator, and the winding having two ends which separately serve as a second contact end for connecting with the external circuit and a second connecting end connected with the first coil body; and a coil base, sheathing the second coil set with exposing the adopting hole, the first contact end of the first coil body and the second contact end of the second coil body;

wherein the first coil set surrounds the adopting hole and is fixed on the coil base to form a coil module, the separator is formed with a positioning hole for being passed by the second contact end.

* * * * *